US012736220B2

(12) United States Patent
Zoz et al.

(10) Patent No.: US 12,736,220 B2
(45) Date of Patent: Sep. 15, 2026

(54) THERMAL PROCESSING APPARATUS WITH A HEATING DEVICE OPERATED WITH HYDROGEN, SUSTAINABLE CREMATION, FREE OF CO2

(71) Applicants: Zoz GmbH, Wenden (DE); Albert Hesse Familienstiftung, Wenden (DE)

(72) Inventors: Henning Zoz, Wenden (DE); Albert Hesse, Wenden (DE)

(73) Assignees: ZOZ GMBH, Wenden (DE); ALBERT HESSE FAMILIENSTIFTUNG, Wenden (DE)

( * ) Notice: Subject to any disclaimer, the term of this patent is extended or adjusted under 35 U.S.C. 154(b) by 828 days.

(21) Appl. No.: 17/980,592

(22) Filed: Nov. 4, 2022

(65) Prior Publication Data

US 2024/0085019 A1 Mar. 14, 2024

(30) Foreign Application Priority Data

Sep. 8, 2022 (DE) ..... 10 2022 122 863.0

(51) Int. Cl.

| | |
|---|---|
| ***F23G 1/00*** | (2006.01) |
| ***F23D 14/12*** | (2006.01) |
| ***F23J 15/02*** | (2006.01) |
| ***F23J 15/04*** | (2006.01) |

(52) U.S. Cl.

CPC ..... *F23G 1/00* (2013.01); *F23D 14/125* (2013.01); *F23J 15/025* (2013.01); *F23J 15/04* (2013.01); *F23C 2900/9901* (2013.01); *F23G 2203/00* (2013.01); *F23G 2203/80* (2013.01); *F23G 2204/103* (2013.01); *F23G 2206/203* (2013.01); *F23G 2900/7009* (2013.01)

(58) Field of Classification Search

CPC ..... F23G 1/00; F23G 2900/7009

See application file for complete search history.

(56) References Cited

U.S. PATENT DOCUMENTS

| | | | | |
|---|---|---|---|---|
| 4,202,318 | A * | 5/1980 | DePodesta | F24H 3/06 126/99 D |
| 6,457,424 | B1 * | 10/2002 | Marz | F23G 5/40 110/211 |
| 8,283,512 | B1 * | 10/2012 | Maganas | F23G 5/46 422/140 |
| 9,976,742 | B1 * | 5/2018 | Olver | F23G 1/00 |
| 2012/0070347 | A1 * | 3/2012 | Bacon | F23G 5/085 422/186.04 |

(Continued)

FOREIGN PATENT DOCUMENTS

| | | |
|---|---|---|
| DE | 196 52 967 | 4/1998 |
| DE | 198 53 572 | 5/2000 |

*Primary Examiner* — David J Laux

(74) *Attorney, Agent, or Firm* — Gudrun E. Huckett

(57) ABSTRACT

A thermal processing apparatus (2) is furnished with a loading device, a cremation chamber (10), a heating device (14) for heating the cremation chamber (10), a fresh air supply device, an exhaust gas manifold (18*a*) for discharging the exhaust gas from the cremation chamber (10), a post-combustion chamber (28), and an exhaust air processing device (38). In order to provide a thermal processing apparatus with which a cremation process with minimal $CO_2$ emissions can be carried out and an acceleration of the cremation process is achieved, it is proposed that the heating device (14) is designed to burn hydrogen.

34 Claims, 5 Drawing Sheets

(56) References Cited

U.S. PATENT DOCUMENTS

| | | | | |
|---|---|---|---|---|
| 2016/0076769 | A1* | 3/2016 | Stanton | F23G 7/06<br>431/75 |
| 2019/0072273 | A1* | 3/2019 | Hirata | F23D 14/126 |
| 2022/0259504 | A1* | 8/2022 | Aslaner | C10G 9/20 |

* cited by examiner

THERMAL PROCESSING APPARATUS WITH A HEATING DEVICE OPERATED WITH HYDROGEN, SUSTAINABLE CREMATION, FREE OF CO2

BACKGROUND OF THE INVENTION

The present invention relates to a thermal processing apparatus with a loading device, a cremation chamber, a heating device for heating the cremation chamber, a fresh air supply device, an exhaust gas manifold for discharging the exhaust gas from the cremation chamber, a post-combustion chamber, and an exhaust air processing device. The present invention also relates to a method for cremation of a corpse in a thermal processing apparatus The modern world is faced with great challenges. Decarbonization for fighting climate change, aftermath of the pandemic with high death rates, and lastly the war in Ukraine with dramatic effects on the energy supply in central Europe. Humanity and inventive spirit—human innovation, belong in this context also to the important factors of success in order to maintain living space, peace, and wealth.

A technology that has been neglected or not considered at all up to now in the conflicting context of vision and feasibility, the cremation at the end of the earthly life, requires according to the prior art fossil fuel or large quantities of electricity and releases, as a combustion process, significant quantities of CO2 into our atmosphere. That in the near future a capacity expansion (a) must be achievable quickly is statistics. That in the near future the cremation of the deceased by means of fossil fuels (b) will no longer be permitted is also foreseeable.

Therefore, a technology is to be provided that satisfies both changed market conditions. I.e., (a) readiness for market release is to be achieved very quickly, at the latest in 2023, and (b) the combustion is to be realized exclusively by supply of hydrogen and, as needed, oxygen; this under exorbitant energy savings, essentially free of emissions, and with significantly improved piety consideration.

A thermal processing apparatus with cremation chamber is disclosed in the publication DE 196 52 967 C1. The walls of a cremation chamber are usually lined with refractory bricks. The refractory bricks are artificially produced bricks or plates that are particularly heat-resistant. They can store heat comparatively well and are therefore used in many fields of heating technology. A cremation process is carried out in such a way that the cremation chamber is initially heated with a heating device to a temperature of above 650° C. prior to a casket with a corpse to be cremated being pushed into the cremation chamber. The heating device is comprised usually of a gas burner which combusts a gaseous fuel in sucked-in fresh air. Through a nozzle, which represents an example of a device for introducing the heating medium into the cremation chamber, the hot exhaust gas is introduced into the cremation chamber. When heating the cremation chamber, the refractory bricks on their side facing the cremation chamber are also heated to this temperature. Because it is not permitted for reasons of piety that the casket and the corpse are exposed during the cremation process to external flames, the heating device must be switched off during the actual cremation process. The process heat consumed during the cremation process is therefore at least to a significant part reflected by the refractory bricks back into the cremation chamber, which heat has been absorbed beforehand during the heating process. In doing so, the refractory bricks cool down again. In order to maintain the temperature in the cremation chamber during the cremation process at a level required for the cremation process, the refractory bricks must line the cremation chamber with a wall thickness with which a quantity of thermal energy sufficient for the cremation process can be absorbed during the heating process. The conventional thermal processing apparatus are therefore very heavy and voluminous. As shown in the publication DE 196 52 967 C1, it is within limits possible to supply during the burning process further supporting energy but the latter serves primarily for post-combusting the burnt gas because the heat stored in the refractory bricks is not sufficient for this.

Due to this process, the cremation of a corpse takes several hours. The cremation chamber is heated up, then the corpse is pushed into the cremation chamber, then the cremation process is carried out, and, at its end, the cremation chamber cools down again in order to be able to remove the pieces of cremated remains from the cremation chamber. Due to heating up and cooling down of the cremation chamber, a high proportion of the energy required for the entire cremation process is lost. The thermal processing apparatus known from the prior art thus operate inefficiently with respect to temporal as well as energetic considerations.

The publication DE 198 53 572 A1 discloses a thermal processing apparatus with a cremation chamber with an electrical heating device which is arranged outside of the cremation chamber and heats it only indirectly. Due to the indirect electrical heating, the filters for cleaning the burnt gases from the cremation are to be relieved of possibly incurred fuel gases from the heating device. By means of an oxygen store, the cremation of the corpse is supposedly possible also in case of a switched-off heating device. The cremation process is thus carried out in the conventional manner.

A disadvantage of the known prior art is to be seen in that a combustion process is very energy intensive. Since the heating device usually heats up the cremation chamber by combustion of natural gas, high $CO_2$ emissions are produced in every combustion process.

It is the object of the present invention to provide a thermal processing apparatus with which a cremation process can be performed with reduced $CO_2$ emissions and an acceleration of the cremation process is achieved.

SUMMARY OF THE INVENTION

The object is solved for a thermal processing apparatus of the aforementioned kind in that the heating device is designed to burn hydrogen. The object is solved for a method in that the heating device which is employed in the cremation method in the thermal processing apparatus is designed to burn hydrogen.

When the heat required for a cremation process is to be produced by combustion of hydrogen, the emission of $CO_2$ is already reduced in that for heat generation no fossil energy carriers are used anymore. Emissions of $CO_2$ are produced only as a result of the intended combustion of the biomass of the corpse and optionally of the combustion of a wooden casket that is placed with the corpse contained therein into the cremation chamber. For conventional thermal processing apparatus, the heat value of a wooden casket is even required in order to achieve and maintain a high process temperature. When using hydrogen as a fuel for the heating device, the heating value of a wooden casket can however be dispensed with because the process temperature that is achievable with hydrogen in the cremation chamber is so high that the combustion process runs reliably even without the heating value of a wooden casket.

In addition, by use of hydrogen the duration of a cremation process is reduced because the hydrogen burns at a higher temperature than the conventionally employed fuels. While natural gas burns in air at temperatures of approximately 1,950° C., temperatures of approximately 2,130° C. are obtained when burning hydrogen in air. When the hydrogen is combusted with pure oxygen, even burn temperatures of up to 3,080° C. can be achieved. Due to the higher burn temperatures which the heating device achieves upon combustion of hydrogen, the cremation chamber during a cremation process can be operated at higher process temperatures. The duration of a cremation process can be already significantly reduced when the hydrogen is burned in air. An even more significant shortening results, of course, when hydrogen is burned in oxygen. The chemical conversion processes upon cremation of a corpse occur faster when higher temperatures are present during cremation.

The term heating device is to be understood in this context as the technical device with which a fuel is burned. It can be a burner that burns the hydrogen and achieves in this context high burn temperatures.

According to an embodiment of the invention, the heating device comprises burner nozzles and burner sleeves that are manufactured of a high temperature-resistant steel and/or a ceramic material. The proposed materials exhibit a high temperature stability and are suitable therefore very well for the use in heating devices in the temperature range at which hydrogen is combusted. When using these materials, the burner nozzles and burner sleeves have a high shape stability and long service life despite the high operating temperatures. In particular ferritic, austenitic or martensitic steels with an increased chromium proportion and/or oxide particle-reinforced and nano-structured ferritic alloys are suitable as temperature-resistant steels. The ceramic material can be, for example, silicon nitride and/or silicon carbide. A silicon carbide composite ceramic can be provided as needed with a special carbon fiber/ceramic fiber reinforcement.

According to an embodiment of the invention, the heating device is operatively connected to a gas-tight radiant tube which is heated by the heating device and which is arranged in the interior of the cremation chamber.

With the high burning temperatures from the combustion of hydrogen, a radiant tube is heated. Operatively connected means that the heat produced by the heating device is transferred to the radiant tube. Heating of the radiant tube is realized by a heating medium such as, for example, a liquid or a gas that absorbs the heat generated by the heating device and transfers it to the radiant tube. The heating medium can be in particular the hot exhaust gas of a burner that is introduced into the radiant tube and is exhausted via an exhaust gas manifold from the thermal processing apparatus. The high temperatures with which the cremation chamber is loaded requires, of course, a corresponding design of all materials which are exposed to the high temperatures in the cremation chamber and in the downstream exhaust gas manifold.

Since the radiant tube is arranged in the interior of the cremation chamber, the heat transported by the heating medium can be released from there with substantially no heat losses immediately into the cremation chamber. In this context, the radiant tube is preferably not embedded in a wall of the cremation chamber but is arranged exposed in the cremation chamber so that it can radiate heat directly into the cremation chamber about its entire circumference and its entire length. Heating of the cremation chamber is realized by the radiant heat of the radiant tube. Therefore, no line and heat losses caused by material in which the radiant tubes might be embedded occur. Since the heat is in particular introduced via the radiant heat of the radiant tubes into the cremation chamber, there is also no heated exhaust gas introduced into the cremation chamber which combines therein with the exhaust gases of the thermal processing apparatus and increases the volume of the exhaust gas to be purified.

When in this context a radiant tube is mentioned, a plurality of radiant tubes can of course be present also in the cremation chamber in the meaning of the invention. One or a plurality of radiant tubes can be connected to a heating device and distribute the heat absorbed in the heating device by the heating medium faster across a larger radiant surface in the cremation chamber. Likewise, a plurality of heating devices can be provided which heat one or a plurality of radiant tubes connected thereto. The plurality of radiant tubes can be installed in a plurality of branched sections in the cremation chamber. The radiant tube or tubes are installed in such a way in the cremation chamber that a high heating performance and at least approximately identical heat distribution within the cremation bracket results. For this purpose, they can have also different diameters in sections thereof or across their entire length. The radiant tubes can form themselves the line through which the heating medium flows. Depending on the employed heating medium, the radiant tubes can also open into a common exhaust gas manifold, through which the exhaust gas can be discharged into the environment or the exhaust gas is released into the environment through its own exhaust gas manifold which is remote from the radiant tubes and arranged downstream thereof. At this point, it must be noted that the exhaust gas when burning hydrogen is purest water vapor and does not correspond to the conventional meaning of the term exhaust gas because it does not contain any other pollutants. In case that a circulating heating medium is guided through the radiant tubes, the radiant tubes can be integrated in a circular line or form themselves a circular line so that the heating medium can be circulated in a circular fashion. The exhaust gas from the heating device can be introduced also into a rearward section of the exhaust gas manifold for the exhaust gases from the cremation chamber in which the exhaust gases from the cremation chamber have already been purified at least partially. The exhaust gases from the heating device and the exhaust gases from the cremation chamber can then be discharged from a common exhaust gas manifold at the rearward end into the environment.

A radiant tube which is embodied to be gas-tight within the cremation chamber fulfills the legal requirements regarding observance of piety because the corpse of a deceased person to be cremated does not come into contact with the flames of an external combustion. In temporal respect, in relation to a cremation process, this results in the advantage that the heating device can be continuously operated during the entire time in which the corpse to be cremated is present in the cremation chamber. Refractory bricks which usually enclose the cremation chamber therefore must not be heated anymore prior to the start of the cremation process to such an extent that the heat stored therein is sufficient to maintain the temperature level required for the cremation process across the entire process duration of a cremation. It is instead sufficient to heat the air temperature in the cremation chamber comparatively quickly with the radiant tube to the prescribed minimum temperature of 650° C. After reaching the minimum operating temperature of 650° C. for the cremation of a corpse, the corpse to be cremated can be introduced already into the cremation chamber and the heating device can be throttled to a heating output that is sufficient to compensate the heat losses that are produced by the cremation process itself and a radiation of heat into the environment. The heating device can then be operated at a throttled output until the cremation process is completed. However, it is also possible to operate the thermal processing apparatus permanently at a high or the highest heat output of the heating device in order to reduce the process time. This is then possible in the cremation chamber at temperatures that are significantly above the legal minimum temperature of 650° C. Therefore, it can also be considered to operate the cremation chamber with a temperature which is significantly above 650° C. or the maximum possible temperature in order to accelerate the cremation of a corpse due to a higher temperature in the cremation chamber. Also, the production of poisonous substances from the cremation process can be possibly reduced due to the higher temperatures. The temperature can also be differently high during a cremation process. For such an operation of the thermal processing apparatus, the heating device, after reaching the prescribed minimum temperature, is not throttled in its output but is further operated at full or at a rather minimally reduced output, for example, in order to not surpass the technical limits such as, for example, the thermal stability of the materials used in the thermal processing apparatus. Already due to the significantly shortened or even entirely eliminated preheating time, a significantly shortened process time for the cremation of a corpse to be cremated results which can be further reduced by the once again increased process temperatures. The higher operating temperatures mean a higher energy consumption but, for a targeted recovery of the expanded heating energy and the shortened process time, the energy quantity employed for a cremation process is not much higher or even lower in comparison to the conventional thermal processing apparatus. This applies in particular when the thermal processing apparatus is operated in permanent operation without operational interruptions.

Already due to the significantly reduced processing time alone, a reduced energy consumption results. The energy consumption for a process cycle is also reduced because it is no longer required to heat the refractory bricks to an energy level which ensures maintaining the minimum temperature during the entire process time. For safety reasons, it is usually higher than actually required. It is now possible to keep the temperature in the cremation chamber approximately precisely at the prescribed level of 650° C. in the cremation chamber due to a corresponding regulation of the heating output of the heating device. Auxiliary heating devices that serve to observe a prescribed temperature level can be dispensed with.

A further significant advantage of the heating according to the invention of the cremation chamber results from the fact that the new heating enables a continuous operation of the thermal processing apparatus. Since the cremation chamber now can be heated during the ongoing cremation, the heating phase in any case and also the cooling phase, for a suitable configuration of the periphery of the cremation chamber, of the conventional cremation process are eliminated. Instead of a cremating operation per working day of one or two bodies to be cremated, in a working day now significantly more bodies to be cremated can be cremated in a thermal processing apparatus according to the invention. The thermal processing apparatus according to the invention has thus a significantly higher cremation output than the prior art thermal processing apparatus.

According to an embodiment of the invention, the heating device is arranged outside of the cremation chamber. When arranging the heating device outside of the cremation chamber, the energy required by the heating devices must not be introduced as fuel or electric current into the cremation chamber, which can be a problem due to the high temperatures that are exiting therein and would pose high demands on the thermal insulation and sealing of the corresponding supply lines. The heating device itself can be of a simpler construction because it is operated at lower environmental temperatures than those existing in the cremation chamber. Also, it is no longer required to provide the wall of the cremation chamber with an additional passage opening for passing through the energy required by the heating device. The heating device is better accessible for maintenance work, and it is simpler to connect the heating device to an electronic control and regulation device for the process control of the cremation process. When the heating device is arranged outside of the cremation chamber, it must be connected to the radiant tube by a corresponding line so that the heating medium heated in the heating device can pass from the heating device to the radiant tube and can heat it there. Finally, the volume of the cremation chamber can be kept smaller when the heating device is arranged outside of the cremation chamber. For the cremation chamber reduced in size, less energy is required in turn in order to heat it to the minimum temperature of 650° C. In this way, the process time for a combustion cycle is lowered and the energy efficiency of the thermal processing apparatus is increased.

According to an embodiment of the invention, the heating device is designed for the combustion of a gaseous or liquid fuel and an exhaust gas manifold is connected to the heating device which discharges the exhaust gas produced during combustion of the fuel into the environment by bypassing the cremation chamber. Since the exhaust gas produced during combustion of the fuel does not reach the cremation chamber, this exhaust gas is also not mixed in the cremation chamber with the exhaust gas of the cremation process. Due to the exhaust gas of the combustion of the fuel in the heating device being kept separate by its own exhaust gas manifold from the exhaust gas of the cremation process, the exhaust gas filters for the exhaust gas from the cremation process are relieved from the corresponding exhaust gas volume. The more complex exhaust gas technology for purifying the exhaust gases from the cremation process must therefore be designed only for the purification of the exhaust gas volume produced by the cremation process itself. The corresponding exhaust gas manifold can therefore be designed significantly smaller, lighter, and more cost-efficient. Due to the strict separation from the exhaust gases of the cremation process, the exhaust gases generated in the combustion of the fuel do not contain in particular problematic pollutants such as dioxins, furans, nitrogen oxides, and mercury vapors which then also must not be filtered out of the exhaust gas and disposed of by complex filtering and other purification technologies. Since the exhaust gases from the heating device which flow out of the radiant tubes are still very hot, it is expedient to harvest the heat energy contained therein by a heat exchanger and to return it to the combustion process prior to the exhaust gas being released into the environment. Preferably, a heat exchanger is therefore integrated in the exhaust gas manifold for the exhaust gas from the heating device, wherein, for the energy recovery from the hot exhaust gas, a heat exchanger can also be used which also cools, parallel but separately, the exhaust gases of the cremation chamber. The energy recovered in the heat exchanger can be converted in an energy recovery device for use in the thermal processing apparatus.

For the exhaust gas from the combustion of the fuel, its own less complex filtering and purification stretch can be provided in order to fulfill the legal requirements for air quality management for the exhaust gas volume originating from the heating device. The thermal processing apparatus thus comprises in this configuration two exhaust gas manifolds operating separately from each other of which the first exhaust gas manifold of a simpler configuration is designed for discharging and purifying the exhaust gases produced during the combustion of the fuel in the heating device and the second exhaust gas manifold of a more complex configuration for discharging and purifying the exhaust gases originating from the cremation process. In the meaning of the invention, the entire conveying stretch along which the exhaust gas from the cremation chamber is being passed through various components of the thermal processing apparatus until it is finally discharged into the environment is to be understood as an exhaust gas manifold for the exhaust gases from the cremation chamber. The exhaust gas manifold includes therefore all components of the post-combustion, cooling, separation of solids, separation of suspended particles, the absorption device, the lime water purifying stage as well as the connection lines positioned therebetween up to the stack.

Finally, due to the separate discharge of the exhaust gas from the combustion of the fuel outside of the cremation chamber, it is possible to lower the air throughput through the cremation chamber to a level which is absolutely required for the actual cremation process. The heat losses in the cremation chamber produced due to the supply and discharge of exhaust gas from a heating device, fresh air and exhaust air, are in this way also lowered to an unavoidable level for the actual cremation process. In this way, the energy demand of a cremation process is also lowered significantly. The fresh air supply can be realized by process control, i.e., adapted to the actual fresh air demand depending on the chemical processes actually occurring in the cremation chamber in the context of the combustion. When in this context reference is being had to fresh air supply, this can be external air, pure oxygen or other compositions of gases.

According to an embodiment of the invention, the radiant tube is designed for an operating temperature above 900° C. and the radiant tube is manufactured of a high temperature-resistant steel and/or a ceramic material. The operating temperature of the radiant tube of above 900° C., which is higher compared to the prior art, accelerates the cremation and can be quickly achieved and maintained with a corresponding heating device. Preferably, the operating temperature is even above 1,000° C. The proposed materials exhibit a high temperature stability and are suitable therefore very well for the use in radiant tubes in the temperature spectrum with which the cremation chamber is operated. When using these materials, the radiant tubes exhibit a high shape stability and long service life despite the high operating temperatures.

As temperature-resistant steels, in particular ferritic, austenitic, or martensitic steels with an increased chromium proportion and/or oxide particle-reinforced and nano-structured ferritic alloys are useable. The ceramic material can be, for example, silicon nitride and/or silicon carbide. A silicon carbide composite ceramic can be provided, as needed, with a special carbon fiber reinforcement.

High temperature-resistant steels and ceramics mean such materials which withstand permanently temperatures above 900° C., preferably above 1,000° C. When a radiant tube is manufactured of such a material, the cremation chamber can be heated very quickly to the value of 650° C. prescribed for the cremation process due to the high temperature excess of the radiant tube. The process times are therefore shortened. Due to the high temperature excess, it is also possible to maintain the prescribed temperature level during the cremation process in phases of a higher conversion of process energy, even when the high energy demand cannot be buffered by the energy which has been stored beforehand in the walls. It is also possible to shorten the process time in that the combustion in the cremation chamber is carried out at temperatures that are significantly above the legally required minimum temperature of 650° C. With a radiant tube which is designed to be high temperature resistant, it is possible to achieve in the cremation chamber process temperatures of 800° C. and above and to maintain them also across a portion or the entire process cycle time. As a result, the high power reserves provided by the high temperature-resistant radiant tubes enable a high savings potential for energy savings in the process as a whole.

According to an embodiment of the invention, at least one of the walls of the cremation chamber is designed as a double wall in which the intermediate space between the first wall facing the cremation chamber and the second wall facing away from the cremation chamber is configured as air guiding channel for supply of supply air into the cremation chamber or for discharge of exhaust air from the cremation chamber. When supplying fresh air, the latter absorbs heat from the first wall of the double wall facing the cremation chamber. It therefore cools this first wall and is itself heated thereby so that, after entering the cremation chamber, it must not be heated only at this time, and completely, to the operating temperature in the cremation chamber. The double wall in this way acts, on the one hand, as a thermal insulation of the cremation chamber which which keeps down the heat discharge from the cremation chamber to the exterior and, on the other hand, as a heating device utilized for using the heat radiating into the intermediate space to heat the fresh air to be supplied to the cremation chamber in order to keep as minimal as possible the energy quantity required for heating the supply air. The double wall thus reduces the insulation expenditure which must be realized for thermal insulation of the cremation chamber, and the double wall increases the energetic efficiency of the thermal processing apparatus.

At the exhaust air side of the cremation chamber, the double wall can be used as a post-combustion chamber. It should be noted here that the exhaust air from the cremation chamber is a multi-phase flow in which gas and solids are moving. In order to enhance the thermal conversion of the gases and solids moved in the exhaust air, it is required by law to maintain in the post-combustion chamber a temperature of at least 850° C. The minimum temperature in the post-combustion chamber is thus still 200° higher than the temperature in the cremation chamber. The exhaust air must also reside in the post-combustion chamber for a minimum duration of 2 to 3 seconds. In that the intermediate space in the double wall is used as a post-combustion chamber, the heat radiation from the first wall, which separates the post-combustion chamber from the cremation chamber, contributes to maintain the minimum temperature level in the cremation chamber. Energetically, the heat radiation from the post-combustion chamber is utilized thus for the cremation process in the cremation chamber. Of the wall structure of the post-combustion chamber, only the outwardly facing second wall of the double wall must be insulated thermally toward the exterior so that the construction expenditure for the cremation chamber is reduced.

The post-combustion chamber can be designed such that it influences the post-combustion burning process beneficially. The intermediate space in a double wall containing the post-combustion chamber can contain a single flow channel or the intermediate space is divided into different flow channels which are separate from each other and arranged adjacent to each other. For example, by tapering of a flow channel, a high flow rate across a long distance can be ensured in order to enhance in this way the solids transport across a longer distance and avoid deposition of solids in the post-combustion chamber as much as possible. The exhaust air can contain glowing particles and flue ash as well as suspended particles which, if possible, should not clog the exhaust air channel in the post-combustion chamber. Also, the prescribed residence times of the exhaust gas from the cremation process can be ensured thereby.

Since the heat transfer from the cremation chamber to the supply air as well as from the post-combustion chamber into the cremation chamber is desirable, the first walls of the double walls facing respectively the cremation chamber can be designed comparatively thin. The first wall can be still constructed as refractory brick but with a significantly reduced wall thickness. It then still acts as mechanically stabilizing and thermally equalizing boundary surface for insulation of the cremation chamber to the exterior. In comparison to the refractory brick walls in the conventional thermal processing apparatus which must be configured particularly thick and heavy in order to be able to store a large quantity of heat, a lot of material of refractory bricks and thus weight and construction expenditure of the device as a whole is saved due to the double walls. This applies also to the insulation of the external walls of the cremation chamber because the second walls of a double wall which is insulated and cooled by supply air are cooler than the walls of a conventionally configured cremation chamber and the post-combustion chamber must be thermally insulated only on one side at the side of the second wall of the double wall.

According to an embodiment of the invention, the distance to be traveled by the supply air and/or the exhaust air in the double wall is extended by a plurality of deflections of the flow by one or a plurality of deflection elements arranged in the double wall. Due to the extension of the flow distance of the supply air in the double wall, it can be heated more strongly. Due to the extension of the flow distance of the exhaust air in the double wall, it resides longer in the high temperature zone in the post-combustion chamber which enhances the chemical conversion of the gases and solids contained in the exhaust air. The deflection elements in the double wall can be arranged in particular labyrinth-like so that an effective extension of the flow distance is provided.

According to an embodiment of the invention, the intermediate space of at least one double wall is used for heating the supply air and the intermediate space of at least one double wall is used as a post-combustion chamber for the exhaust air, wherein the double wall volume for heating the supply air is larger than that for the post-combustion chamber. It is already possible to divide only a single double wall accordingly. In case of a rectangular base surface of the cremation chamber, for example, the more narrow end wall of the cremation chamber can also be embodied as a double wall for a post-combustion chamber for the exhaust air, while a longitudinal side of the cremation chamber comprises a double wall used for heating the supply air. For the same wall thickness and height of the double walls, a larger volume for heating the supply air results in this way. It is also possible to utilize three side walls of the cremation chamber designed as double wall for heating the supply air while only one side wall embodied as a double wall is used as a post-combustion chamber.

According to an embodiment of the invention, a bottom segment of the cremation chamber is movable back and forth in vertical direction by means of a lifting device between a closed position closing the cremation chamber in downward direction and an open position located below in which the cremation chamber is opened in downward direction. Due to the bottom segment which is movable in vertical direction, loading of the cremation chamber with a corpse to be cremated can be realized. The bottom segment together with the lifting device represents a type of lifting table which can be lowered from the closed position so far in downward direction that, in the open position, it can be loaded from the side with a corpse to be cremated and from which, after cremation, the remains of a corpse can also be removed to the side. When the bottom segment is in the closed position, the cremation chamber is closed off in downward direction and a corpse can be cremated in the cremation chamber. Loading of the cremation chamber from below in place of conventional loading through a furnace door which is laterally mounted at the cremation chamber is thermodynamically and energetically ideal because in this way the heat losses are kept low. The bottom segment has dimensions which are large enough in order to be able to convey corpses of usual sizes, lying on the bottom segment, into the cremation chamber.

According to an embodiment of the invention, the bottom segment comprises thermal insulations at its circumferential rims and/or at its bottom side and/or at an interface to the lifting device. Even through the bottom segment in its closed position is located only at the bottom side of the cremation chamber, it is heated during the course of a combustion cycle at least approximately to the temperature which the cremation chamber has during cremation of a corpse. The temperature amounts therefore then at least approximately to minimally 650° C. In order to reduce the heat radiation to the exterior across the surface of the bottom segment, but also via the joints to the adjoining components of the cremation chamber and to the lifting device, it is advantageous to thermally insulate the corresponding components at the bottom segment. The insulation can be realized by components which withstand the operating temperatures of the bottom segment and dissipate the existing heat only badly.

According to an embodiment of the invention, the bottom segment at its circumferential rims and/or at its bottom side and/or at an interface to the lifting device and/or adjoining components of the thermal processing apparatus comprise water cooling. By means of water cooling, the interfaces of the bottom segment to adjoining components of the thermal processing apparatus can be kept at a thermally uncritical range. The components of water cooling and the output-based configuration of the cooling apparatus can be adapted to the desired temperature which the bottom segment should have in the cooled regions.

According to an embodiment of the invention, the bottom segment is connected to an interrupter switch that switches off or regulates down the heating device, a supply air blower and/or an exhaust air blower when the bottom segment is not in its closed position. Heat losses during a load change are significantly reduced.

According to an embodiment of the invention, an interchangeable vessel is placed onto the bottom segment at which carrying elements are formed by means of which the interchangeable vessel is movable. During the cremation process, the interchangeable vessel serves as a support and catch basin for solids, oils, and fats that form during cremation. The interchangeable vessel is therefore preferably downwardly closed and comprises lateral rims that project past the remaining surface of the interchangeable vessel in upward direction. The interchangeable vessel can extend across the entire bottom surface of the cremation chamber and provides an improved protection against cross-contamination in this way. A casket or an interchangeable casket can be placed onto the interchangeable vessel prior to the interchangeable vessel with the casket placed thereon being lifted into the cremation chamber. The interchangeable vessel itself can also form an interchangeable casket into which a corpse to be cremated is placed. The casket or interchangeable casket can also be burnt during the cremation process, or an interchangeable casket is utilized which, for example, is manufactured of a high temperature-resistant steel and is therefore reusable and does not burn during the cremation process in order to keep the $CO_2$ load of the exhaust air from the cremation process as low as possible. The interchangeable vessel simplifies removal of the remains of a corpse from the cremation chamber. The interchangeable vessel is simply removed in downward direction from the cremation chamber, it can be removed from the bottom segment and, remote from the thermal processing apparatus, cremated remains of a corpse can be cleaned of. In this way, it is possible to remove individually all remains of a corpse separate from the remains of other corpses from the cremation chamber and to collect them in an urn in which then only the remains of a particular person are contained, which is required for reasons of piety.

After the end of the cremation process, the interchangeable vessel can be removed from the bottom segment. Subsequently, from the interchangeable vessel solids and ash resting thereon can be removed and placed into a personal urn that contains only the remains of a single person. When using one or a plurality of interchangeable vessels, the bottom segment thus serves the purpose of simplifying loading and unloading of the cremation chamber and of improving the precision in respect to the individual assignment of cremated remains to an individual corpse. At least one interchangeable vessel can be utilized for the preparation of a corpse for cremation and the discharge, separation, and processing of the cremated remains. For receiving a new corpse and removing the cremated remains from the cremation chamber, the latter must therefore only be briefly opened so that in this context only a minimal heat loss is produced. By means of a plurality of interchangeable vessels used in circulation, onto which a casket is placed for preparation of a cremation, which are present in the cremation chamber, which are emptied after cremation, allowed to cool and are cleaned after cooling, a continuous permanent operation of the thermal processing apparatus is possible.

Via the carrying elements, an interchangeable vessel can even be moved when it is heated by the cremation process. Preferably, the carrying elements are shaped bodies which are connected as one piece to the interchangeable vessel, for example, sheet metal tabs folded once or multiple times, eyes which are punched into the sheet metal and the like, which can be simply manufactured even for high temperature-resistant steels or ceramic materials. The conveying aids used to move the interchangeable vessels comprise advantageously tools which are shaped to fit the carrying elements in order to be able to safely grip, lift, move, and put down an interchangeable vessel.

According to an embodiment of the invention, the interchangeable vessel is manufactured of a high temperature-resistant steel, a ceramic material and/or a composite material. When the interchangeable vessel is manufactured of such a material, it is capable of withstanding the thermal load in the cremation chamber. For the advantages and properties of the aforementioned materials for an interchangeable vessel, the aforementioned explanations regarding a high temperature-resistant radiant tube apply likewise. The interchangeable vessel and also the interchangeable casket are preferably not provided with a cover because the latter could act as a heat shield that impairs the cremation process. The interchangeable vessel or the interchangeable casket can be provided with a textile liner or a fleece cover in order to fulfill piety considerations.

According to an embodiment of the invention, below the cremation chamber a conveying device with a loading station, an interchange station, and a discharge station is arranged with which the interchangeable vessels can be supplied to the bottom segment and/or removed from the bottom segment. The conveying device serves the purpose of supplying and removing the interchangeable vessels. For the conveying device, a loading station, an interchange station, and a discharge station are provided in order to be able to move the interchangeable vessels accordingly back and forth between these positions. For the conveying device, all suitable conveying means can be employed in order to move back and forth the interchangeable vessels between the loading, interchange, and discharge stations, wherein also conveying aids such as forklifts or lift trucks can be used partially or entirely. For handling the interchangeable vessel and/or the interchangeable casket, also an industrial robot can be used which appears to be expedient with respect to the high temperatures at which these elements are coming out of the cremation chamber.

According to an embodiment of the invention, the conveying device is configured as a conveying carriage with at least two placement positions for interchangeable vessels. The conveying carriage can be mounted on rails on which the conveying carriage can be moved back and forth by a drive. The conveying carriage can also be designed as an autonomously moveable, for example, also driverless, or forcibly guided vehicle which moves automatically or controlled by a person back and forth between various positions. The at least two placement positions of the conveying carriage serve for conveying thereon simultaneously an interchangeable vessel still to be supplied to the cremation chamber and an interchangeable vessel freshly removed from the cremation chamber. When supplying a new casket to the cremation chamber, the first placement position can be free and the interchangeable vessel with the casket to be supplied can be positioned on the second placement position. Upon moving the conveying carriage from the receiving position into the interchanging position, an interchangeable vessel still located in the cremation chamber can be placed with the bottom segment onto the first placement position. After a short subsequent lateral travel movement of the conveying carriage into a position appropriate therefor, the bottom segment can receive the second interchangeable vessel from the second placement position of the conveying carriage and move it upwardly into the cremation chamber so that then the second placement position is free. The conveying carriage can subsequently move into a discharge position in which the still hot interchangeable vessel removed from the bottom segment can be picked up by the conveying carriage and conveyed into an emptying area so that the first placement position is also free. The conveying carriage can then return into its initial position in order to be supplied again with an interchangeable vessel. In only one drive cycle, due to the two placement positions, two interchangeable vessels can be moved simultaneously at least partially. The operation of the conveying carriage can be automated with a comparatively minimal expenditure.

According to an embodiment of the invention, the interchangeable vessel and/or an interchangeable casket and/or a cover are provided with a solids pouring opening. By means of the solids pouring opening, the pouring process is simplified. The solids pouring opening can be designed as an outwardly folded outlet which is formed in a side wall of the interchangeable vessel, of the interchangeable casket, and/or a cover which, as a component of the tilting device, is attached to the interchangeable vessel and/or the interchangeable casket. The solids pouring opening can taper in a funnel shape in order to avoid pouring losses. The solids which are flowing out of the solids pouring opening can flow into the inlet of a grinding processor in which the solids, in particular bones, are ground to a meal. In the pouring region, a filter cloth adapter can be present that seals the intermediate space between the solids pouring opening and the inlet.

According to an embodiment of the invention, the thermal processing apparatus comprises a tilting device for tilting an interchangeable vessel and/or an interchangeable casket. The tilting device can in particular adjoin a discharge station a tilting device for tilting an interchangeable vessel and/or an interchangeable casket. The tilting device forms an optional component of the thermal processing apparatus. By means of the tilting device, remains of a cremated corpse still contained in the interchangeable vessel or an interchangeable casket can be discharged. In the tilted position of the interchangeable vessel and/or of the interchangeable casket, the remains of the corpse which are resting on the interchangeable vessel and/or in the interchangeable casket drop, caused by gravity and/or caused by a corresponding emptying aid such as, for example, a scraper, a broom or the like, into a catching device which forms a part of the tilting device and from where the remains collected therein can be supplied to an urn. Generally known technical devices can be employed for the tilting device. A component of the tilting device can be a cover that is placed onto the interchangeable vessel or the interchangeable casket in order to reduce the dust developed during tilting.

According to an embodiment of the invention, the thermal processing apparatus comprises an inspection station for inspection of the mortal remains of a corpse which is arranged upstream or downstream of the tilting device and upstream of a grinding processor, wherein the inspection station is provided with a metal separator. Prior to entry into a grinding processor of a bone crusher, as is conventional in the prior art, implants, casket fixtures and other metallic objects which have not be decomposed in the cremation chamber can be manually picked out. The bone crusher can be preferably a slow moving blade granulator in order to avoid damages at the grinding processor. For inspecting the remains, the cover of the interchangeable vessel can be provided at the end of the slanted side with a flap or can swing open. However, a metal separator can be arranged also between the interchangeable vessel and the bone crusher. Most implants which are mostly manufactured of non-ferrous metals would not react with a magnet separator. Nevertheless, the aerodynamic metal separator can be relieved by a magnet filter which is in particular arranged upstream. Separation process and transfer can be carried out dust-free, metallic residues can be correspondingly removed in batches and given to the bereaved by request or can be anonymously stored intermediately in a metal collection vessel and finally supplied to a metal recycling/reclamation process. Preferably, an aerodynamic separator which separates in accordance with different material densities can be provided.

According to an embodiment of the invention, the cremation chamber comprises a supply air blower and/or an exhaust air blower correlated with the exhaust gas manifold, wherein the supply air blower and/or the exhaust air blower are connected to an electronic control and regulating device for process control of the cremation process, wherein the control and regulating device comprises a software program with which the conveying outputs of the supply air blower and/or the exhaust air blower can be controlled.

The combustion process in the cremation chamber is not linear in regard to chemical considerations. It is instead so that the corpse to be cremated in a first phase is only heated, then a phase begins in which a lot of the water contained in the corpse evaporates, which requires a lot of energy but does not yet trigger a high oxygen demand, the oxidation and other chemical reactions begin parallel to evaporation of the water and, during the further course of time, increase more and more so that an increasing amount of oxygen is required and whereby energy and exhaust gases are released and then, after some time, the chemical conversion with a correspondingly reduced heat and fresh air demand slows, whereupon then the cremation process ends. From this non-linear course of the cremation process it can be seen that the energy demand as well as the fresh air demand during the cremation process vary. By means of the control and regulating device and a corresponding method for process control of the cremation process, it is possible to control the energy supply by means of an output regulation of the heating device as well as the fresh air supply and equivalently the oxygen supply by an output regulation of the supply air blower and of the exhaust air blower.

An output regulation can be utilized also in order to avoid mixing of flue ash residues of different cremation processes in the exhaust gas manifold due to a regulated process control of the supply air blower and/or of the exhaust air blower. When the cremation chamber is open, the control and regulating device regulates a minimal vacuum in the system so that minimal heat loss without dust emissions can be ensured. During the ongoing cremation, flue ash is collected continuously in the separator and separated in the separator and the dust filter, provided the supply air blower and/or the exhaust air blower are operating. The flue ash of a preceding cremation has then already been conveyed and collected previously. The system is locked internally due to the rotary gate valve directly below the separator.

The temporal course of two sequential cremation processes is as follows: Removal of the interchangeable vessel from the cremation chamber from the cremation process (a) and the insertion of the interchangeable vessel of the process (b) can be done simultaneously by the conveying device. Pivoting of the interchangeable vessel (a) in the tilting device will occur only insignificantly faster than closing of the cremation chamber for process (b), i.e., reloading of the thermal process. Emptying of the interchangeable vessel (a) with remains of the cremation (a) is therefore performed when the cremation (b) is already started. In order to prevent mixing of flue ash (a+b), the gas flow, as described before, can be reduced to a minimal vacuum as soon as the cremation chamber is opened. At the same moment, the cleaning sequence of the filter cartridges can be started; all this is done while the cycle lock is operating. The cleaning process stops at the moment when the movable bottom plate of the opened cremation chamber is moved farther upwardly again. The time span "moving up" of approximately seconds is sufficient for the cleaned-off dust to have been able to pass the separator and the cycle lock quasi in free fall. As soon as the cremation chamber is closed again, the cycle lock stops at least until the ash capsule for (a) is filled and removed and the next ash capsule for (b) is inserted. For example, the cone tube of the separator can serve as a buffer store; it can be configured for this purpose with a larger volume or an additional lockable vessel can be provided. Should structural conditions conflict, for example, with a direct supply of the flue ash from the separator to a grinding processor, it is also possible to connect an urn to the cycle lock for each individual batch. The respective urn can be precisely the vessel which immediately after receiving solids at the cycle lock is transported to a grinding processor in order to be loaded with the cremation remains pieces of precisely the same batch. The grinding processor can be provided with a buffer vessel for this purpose.

In order to be able to control and regulate the cremation process properly, it is advantageous when the control and regulation device is connected to suitable sensors which, for example, measure the temperature in the cremation chamber, the temperature in the post-combustion chamber, the relative humidity in the exhaust gas, the CO and/or $CO_2$ values in the exhaust gas and/or other process-relevant values and transmit them to the control and regulation device. The transmitted sensor values can be evaluated by a suitable software by the control and regulation device and can be incorporated into the output regulations of the heating device as well as of the supply air and exhaust air blowers. In case of an output control of the heating device as well as of the supply air and exhaust air blowers matched to the actual course of the cremation process, significant energy savings are obtained for the cremation process.

As supply air blower, in particular a side channel blower can be employed. A side channel blower is comprised of an annular divided housing in which an impeller with vanes is rotating. The vanes which closely pass the inlet suck in the gaseous medium to be compressed into the side channel blower. The vanes accelerate the gas forwardly and outwardly. The annular housing deflects the gas and guides it back to the base of following vanes. Each of these spiral cycles which occurs multiple times for one revolution of the impeller effects the dynamic pressure increase of the gas. At the end of the revolution, the vanes push the compressed gas without pulsation through a constricted static chamber to the outlet opening. When in an apparatus two channels or impellers are connected in parallel, an air quantity as large as possible is obtained. When two channels or impellers are serially connected, a two-stage compression is achieved. A side channel blower can be operated without cooling with a high conveying output and a high energy efficiency as a supply air blower.

An air pump of preferably comparatively higher output and with water cooling, preferably a turbine, can be used as exhaust air blower.

According to an embodiment of the invention, the supply air blower and the exhaust air blower can be regulated by the software program to output values at which an atmospheric pressure or an excess pressure is adjusted in the cremation chamber. According to the prior art, thermal processing apparatus are operated always at a vacuum in order to prevent that exhaust gases can escape uncontrolled into the atmosphere. Since a cremation chamber can be sealed at most at a very high expenditure toward the exterior against the atmospheric pressure, the exhaust air blower in the known thermal processing apparatus are operated at a conveying output at which a vacuum in relation to atmospheric pressure is adjusted in the cremation chamber. Due to the vacuum in the cremation chamber in case of a cremation chamber which is not completely air tightly sealed, an excess of fresh air can however flow into the cremation chamber; this is not required for the actual combustion process so that unnecessary heat losses are produced. For a pressure regulation to the atmospheric pressure or an excess pressure, such an excess of incoming fresh air in the cremation chamber is avoided. With such a pressure regulation, unnecessary heat losses, an unnecessarily high conveying output of the exhaust air blower as well as unnecessarily large exhaust air quantities in the exhaust air purification can be avoided.

According to an embodiment of the invention, the thermal processing apparatus comprises only one supply air blower that forces the exhaust gases from the cremation chamber into the post-combustion chamber and into the exhaust gas manifold, and the cremation chamber, with the exception of the exhaust air opening to the post-combustion chamber, is configured to be gas-tight. The vacuum operation of the cremation chamber as it is known from the prior art has disadvantageous effects on the temperature management in the cremation chamber and the total energy consumption of the thermal processing apparatus. In order to be able to produce vacuum, at the hot exhaust gas side of the cremation chamber a suction blower is required which pulls, via the vacuum generated in the cremation chamber, constantly cold fresh air into the cremation chamber which is not configured to be gas-tight. In this way, heat losses in the cremation chamber are produced that can be avoided when the cremation chamber is not operated at vacuum. In order to avoid an undesirable uncontrolled escape of exhaust gases from the cremation chamber, the supply air blower is arranged at the fresh air side with which a fresh air flow which can be controlled well with respect to quantity can be blown into the cremation chamber. Due to the controlled fresh air supply, unnecessary heat losses in the cremation chamber are avoided, in particular also when the quantity of the supplied fresh air is determined based on sensor data which represent process-relevant reaction conditions in the cremation chamber and which, with their software-supported evaluation, indicate which fresh air and oxygen quantities are actually required in the cremation chamber. In this way, the supply air blower can be controlled such that it supplies increased fresh air quantities to the cremation chamber in a matching quantity only when this quantity is actually needed for the ongoing chemical processes, and the fresh air supply is reduced and possibly even completely stopped when no fresh air is required for the chemical processes. The fresh air which is blown into the cremation chamber indeed produces therein, in relation to the atmospheric pressure in the environment of the thermal processing apparatus, an excess pressure which results from the exhaust gas counter pressure of the post-combustion chamber and the exhaust gas manifold and an additional pressure control valve which may be possibly present thereat. Since the cremation chamber with the exception of the exhaust gas opening to the post-combustion chamber is however embodied to be gas-tight, the exhaust gases from the cremation chamber, despite the existing excess pressure present therein, can exit only through the exhaust gas opening into the post-combustion chamber from the cremation chamber. From the post-combustion chamber, the exhaust gas from the cremation chamber is cooled and purified before it is discharged energy-reduced into the environment. In this way, it is ensured that no contaminated exhaust gases can reach the environment. The gas quantity which is to be purified by the exhaust gas manifold is less when the fresh air does not flow uncontrolled and not in an excess quantity into the cremation chamber, and the exhaust gas manifold as a whole can be dimensioned smaller so that the manufacturing and operating expenditure for the thermal processing apparatus can be kept smaller. Since the supply air blower operates at the cold side of the cremation chamber, it does not require particular precautions against the heat of the exhaust air such as, for example, separate cooling, and is therefore also less complex in respect to manufacture and operation.

According to an embodiment of the invention, a heat exchanger is connected to the post-combustion chamber by means of an exhaust air line in which heat from the exhaust air flow is transferred to a heat medium that circulates between the heat exchanger and an energy recovery device in a loop. The exhaust air that flows out of the post-combustion chamber has a temperature of at least 850° C. Since this high temperature level for the subsequent purification of the exhaust air in the best case is not required and in the worst case is even a hindrance, the exhaust air in flow direction of the exhaust air should be cooled downstream of the post-combustion chamber. For technical reasons, it is also advantageous to reduce the temperature of the exhaust gas because the downstream components are then less strongly thermally loaded and therefore can be designed technically less complex. Since the exhaust air from the post-combustion chamber is hottest directly behind the post-combustion chamber, it is proposed to guide the exhaust air at this location into a heat exchanger in which the exhaust air is cooled. Since here the heat difference between the exhaust air and the heat medium is largest, a particularly large quantity of heat energy can be transferred from the exhaust air onto the heat medium and the exhaust air can be effectively cooled in this way. Since directly behind the post-combustion chamber also no significant heat losses in the exhaust gas have occurred, it is possible at this location, on the one hand, to utilize the full potential of recoverable energy for the energy recovery, on the other hand, to lower however the exhaust gas temperature significantly in order to improve and more efficiently design the exhaust gas purification. Due to the transfer of the heat energy onto the heat medium, the heat medium can transfer the energy absorbed by it to an energy recovery device in order to utilize the energy contained therein as much as possible for the cremation process, the generation of electricity or for other types of energy consumption.

According to an embodiment of the invention, the heat medium is a phase-changing liquid and the energy recovery device is a steam turbine driven by the phase-changing liquid, the steam turbine has arranged downstream thereof a current generator driven by it, and the current generator converts the rotational energy of the steam turbine into electric current. As a heat medium, for example, water can be used that is heated to steam in the heat exchanger. For heat recovery, instead of water however also other suitable media can be used as heat medium. In the energy recovery device, the heat energy can be converted into electric current which then again can be utilized for the cremation chamber, for example, as directly employed electric energy for producing process heat or indirectly via the production of hydrogen with an electrolysis device, wherein the generated hydrogen is used as fuel in the heating device in order to heat the radiant tubes. The oxygen which is produced by electrolysis can be blown directly in pure form or at least as fresh air additive into the cremation chamber in order to reduce the fresh air volume for the cremation process and to reduce the energy demand required for heating. By means of the loop, the heat medium is returned from the energy recovery device back to the heat exchanger in order to absorb again energy from the exhaust air. The absolute quantity of the energy required for the operation of the cremation chamber can be reduced by the recovery of at least part of the energy contained in the exhaust gas.

In order to reduce the risk of separation of solids entrained with the exhaust gas in the heat exchanger, it is advantageous when in the heat exchanger, if possible, no dead space is present, if possible, no edges are formed in the interior of the heat exchanger and the flow channel in the heat exchanger comprises, if possible, a free passage for the exhaust gas flowing through. It is possible to lower the exhaust gas flowing as a multi-phase flow through the heat exchanger in the heat exchanger to a temperature level of <200° C. so that a separation degree of solids as high as possible is achieved in the downstream solids separation.

According to an embodiment of the invention, a separator for separating solids from the exhaust gas is connected downstream of the post-combustion chamber. The separator can be, for example, a cyclone operating as a centrifugal separator. As separation methods, centrifugal forces are used which are produced by generating an eddy flow. In the centrifugal separator, the gases, as carrier of the solid particles to be separated, are caused to perform a rotational movement as a result of their own flow by the correspondingly designed stationary separator. The solids are separated in the centrifuge by density differences relative to the surrounding gas fraction, in the centrifugal separator by the particle mass. Instead of the cyclone, also other generally known separation technologies can be employed. The surfaces in the separator can clean themselves in operation due to the solids sliding down due to gravity; depending on the employed separator type, the exhaust air flow can also be interrupted temporarily for this purpose. Also, the inner walls of the separator can be hit in a targeted fashion or caused to vibrate in order to enhance the detachment of the solids by gravity. The separator can comprise a cooling device in order to further cool the exhaust gas but also for assisting the separation process due to cooler separation surfaces.

According to an embodiment of the invention, the collecting container which can be supplied through a cycle lock is connected to the separator. The cycle lock closes the separator in downward direction. Solids collected in the separator slide downwardly in the separator and collect in front of the cycle lock. The separator can run continuously without interruption in this context. The solids separated in the separator must be removed in certain time intervals in order to avoid overloading the separator. According to the prior art, the solids which are removed from the exhaust gas surprisingly are not subject to a particular piety-based treatment. The cycle lock makes it possible to empty the solids from the separator in such a way that in the collection container only the solids are collected which have been separated in the separator during the cremation of a specific corpse. Through the collection container, the solids contained therein can be supplied to an urn provided for receiving the mortal remains of a specific person, or to the grinding processor for processing the cremated remains from the cremation chamber. The urn can also be connected directly to the cycle lock. It is also possible to supply the solids collected in the collection container by a feeding means such as a pipe to the grinding processor with which the remaining solids from the cremation chamber are ground to a meal and filled into an individual urn. In this way, the solids collected in the separator from the cremation of a specific corpse are supplied to an urn together with the solids of this specific corpse from the cremation chamber. In this way, a piety-based treatment of the solids separated from the exhaust gases is possible. A regulatory permissible, but with respect to piety questionable admixture of flue ash residues of a plurality of corpses and their joint storage and disposal as special waste can thus be avoided. The cycle lock can be controlled and actuated by the electronic control and regulation device via the correlated software in order to open the cycle lock and, in this way, empty the solids collected in the separator into the collection container. The electronic control and regulation device can open the cycle lock at least at the end of the cremation of a corpse and close it again, wherein also the permanent opening or a one-time or multiple opening actions during the cremation process of a corpse are possible. The electronic control and regulation device can open or close the cycle lock also only during a load change in the cremation chamber. The cycle lock can also be actuated correspondingly manually or by actuation of an actuating drive.

According to an embodiment of the invention, downstream of the separator a dust gas filter for filtering the exhaust gas is connected to the separator. The dust gas filter serves the purpose of separating from the exhaust gases exiting from the separator suspended particles entrained therein which have not been already separated in the separator. In addition to the purely physical suspended particle separation, the dust gas filter can also take on the function of a mechanical-chemical reactor. An automatic cleaning device may be provided additionally for the dust gas filter. Suspended particles can be cleaned from the surfaces of the dust gas filter in that the exhaust air flow is interrupted. Also, the inner walls of the dust gas filter can be caused to vibrate in a targeted fashion in order to assist in detachment of the solids by gravity. A dust gas filter can also be cleaned during operation by a pressure surge via a bypass. When the dust gas filter is arranged vertically precisely above the separator and the cycle lock, the released suspended particles can drop into the separator and from there can be discharged into the collection container like the other solids separated thereat.

The dust gas filter can comprise for filtration of the suspended particles one or a plurality of filter cartridges. The filter cartridges can be connected to a cooling device in order to be able to withstand in permanent operation the hot exhaust gases and/or in order to further cool the exhaust gas. The filter cartridges can contain a purifying stage with active carbon and/or zeolite and/or an individual purifying stage is present in which critical ingredients in the exhaust gas such as, for example, dioxins, furans, and/or mercury, are filtered out with active carbon and/or zeolite.

A conventional purification stage in which the exhaust gas is purified in an entrained flow method can be provided also, or as a substitute, for filtering out mercury vapors. Here, a two-phase flow of a gas and a solid or a liquid as adsorber is utilized with which the mercury is adsorbed. The entrained flow method can be used, for example, in a dynamic adsorber bed. An adsorption of mercury functions however only at temperatures below 100° C. As an alternative to the entrained flow method, also filter cartridges with active carbon and/or zeolite or commercial granular material can be used for absorption at temperatures below 100° C.

According to an embodiment of the invention, an absorption device for filtering the exhaust gas is connected to the separator or the dust gas filter downstream of the separator. An absorption of mercury vapors is in particular expedient at exhaust gas temperatures of >140° C. because Hg in such temperature ranges does not adhere to suspended particles. The absorption device can comprise one or a plurality of absorption cartridges in which mercury vapor in solution can be oxidized. As oxidation agents, for example, potassium permanganate in sulfuric acid solution with, potassium dichromate in nitric acid solution or nitric acid can be used. Mercury vapor can also be absorbed by chelate forming agents; for this purpose, for example, dimercapto succinic acid (DMSA) or dimercapto propanesulfonic acid (DMPS) can be used. These acids can form stable water-soluble complexes with the heavy metal.

According to an embodiment of the invention, a heat exchanger is arranged between the separator, the dust gas filter, and/or the absorption device. The heat exchanger can be used to return further heat energy into the process but it is in particular also usable in order to cool the exhaust gas for the subsequent filtration processes. In order to be able to remove solids which may deposit on the walls in the heat exchanger from the heat exchanger, the inner walls of the heat exchanger caused to vibrate in a targeted fashion in order to assist in the detachment of the solids by gravity. The heat exchanger can be arranged vertically above the separator in such a position that the solids that become detached fall into the separator.

According to an embodiment of the invention, at least two parallel connected and alternately operable dust gas filters are arranged in flow direction downstream of the separator for filtering the exhaust gas, and the respective inactive dust gas filter can be operated in a cleaning mode. It is possible that a dust gas filter cannot be cleaned within a time window in which a load change of the cremation chamber is carried out. In such a case, it is advantageous when the dust gas filter to be purified can be shut down in order to be able to clean it thoroughly independent of a newly started cremation process. A thorough cleaning can be realized, for example, when the dust gas filter to be presently cleaned can be loaded with a countercurrent air flow in order to detach and collect adhering suspended particles. The flow reversal in the dust gas filter then remains limited to the dust gas filter to be cleaned, and it is not necessary to enable a countercurrent airflow to flow through the entire system. The solid particles that become detached can be collected in a separate smaller separator and supplied to the collection container.

According to an embodiment of the invention, the thermal processing apparatus comprises a lime water cleaning stage through which the exhaust air is passed with a supply and a discharge line before the exhaust air is discharged into the environment. Lime water is comprised of a solution of calcium hydroxide in water. When a $CO_2$-containing exhaust gas is passed through the lime water, the $CO_2$ reacts with the calcium hydroxide to calcium carbonate and water. When the entire $CO_2$ contained in the exhaust gas is converted chemically to calcium carbonate and water, the combustion is $CO_2$-free. When a fossil fuel is used as a fuel for the operation of the heating device, the $CO_2$ quantities which are produced in combustion are rather significant, and a large quantity of calcium hydroxide would be required in order to chemically convert this quantity completely. However, when hydrogen is employed as a fuel, for example, or heating of the radiant tubes is realized by electric current, $CO_2$ in the cremation chamber is produced only from the carbon of the cremated corpse and possibly of the casket when no metallic interchangeable casket is used for cremating the corpse. In this case, a $CO_2$-free combustion process is then possible already by use of only approximately 24 kg of calcium hydroxide for a weight of a corpse to be cremated of approximately 100 kg. However, it is of course also possible to utilize the lime water bath in order to achieve a reduction and not a complete elimination of $CO_2$ in the exhaust gas released into the environment. The process heat for the chemical reaction can be taken from the exhaust gas flow by a heat exchanger. The lime water cleaning stage can be optimally added to a combustion process, for example, when the relatives desire a $CO_2$-free or $CO_2$-reduced cremation of the corpse.

According to an embodiment of the invention, the exhaust gas manifold at one location comprises a branch to which a line connected to the cremation chamber is connected for return of at least a portion of the exhaust gas into the cremation chamber. In order to produce a more beneficial cremation in particular with reduced nitrogen oxides and a reduced exhaust air volume, the exhaust air of the cremation chamber can be returned partially into it. This can have the result that a comparatively high gas flow in the cremation chamber leads to an improved mixing, thus to an increased surface availability for the oxidation reaction without increasing the exhaust air volume that is to be purified later on. In this context, an exhaust gas return at reduced temperature can have also the result that pollutants and fuel consumption are reduced. The proposed invention provides two possible solutions for this. On the one hand, an exhaust gas return can be realized immediately at the exit of the double wall from the cremation chamber or the post-combustion chamber, this by accepting that also solids may enter the return circuit. On the other hand, an exhaust gas return can also take place at the exit channel of the separator, the exhaust gas has then been cooled in the heat exchanger between the cremation chamber and the separator as well as within the separator. For a further reduced return temperature, the exhaust gas flow can be returned partially into the cremation chamber at the end of the exhaust gas manifold even after passing a heat exchanger or the energy recovery device. This would also have the result that the same exhaust gas is guided multiple times through the filter/cleaning units which leads to a more complete exhaust gas processing.

According to an embodiment of the invention, the thermal processing apparatus comprises an interface for measuring pollutants at the flow stretch of the exhaust gas between the separator and the blow-out end of the exhaust gas manifold. Observance of the regulatory limits for pollutant loads of the environment must be documented for the thermal processing apparatus. The measurement of the pollutant values is realized after the first start of operation and thereafter in regular intervals by inspection companies. Via the interface, corresponding measurement sensors can be inserted into the exhaust gas manifold in order to take samples or to measure the pollutant load of the exhaust gas moving in the exhaust gas manifold. The interface can be embodied, for example, as a DN 40 ISO KF stainless steel flange. The employed measuring apparatus can be used as mobile device in order to be able to inspect different facilities.

It should be noted that the afore explained embodiments of the invention each by themselves but also in an arbitrary combination with each other can be combined with the subject matter of the independent claim, provided no technically forced obstacles stand in the way. Further deviations and details in the embodiment of the invention can be taken from the following subject matter description and the drawings.

BRIEF DESCRIPTION OF THE DRAWINGS

The invention will be explained in the following with the aid of an embodiment. It is shown in.

PREFERRED EMBODIMENTS

Figure 1:
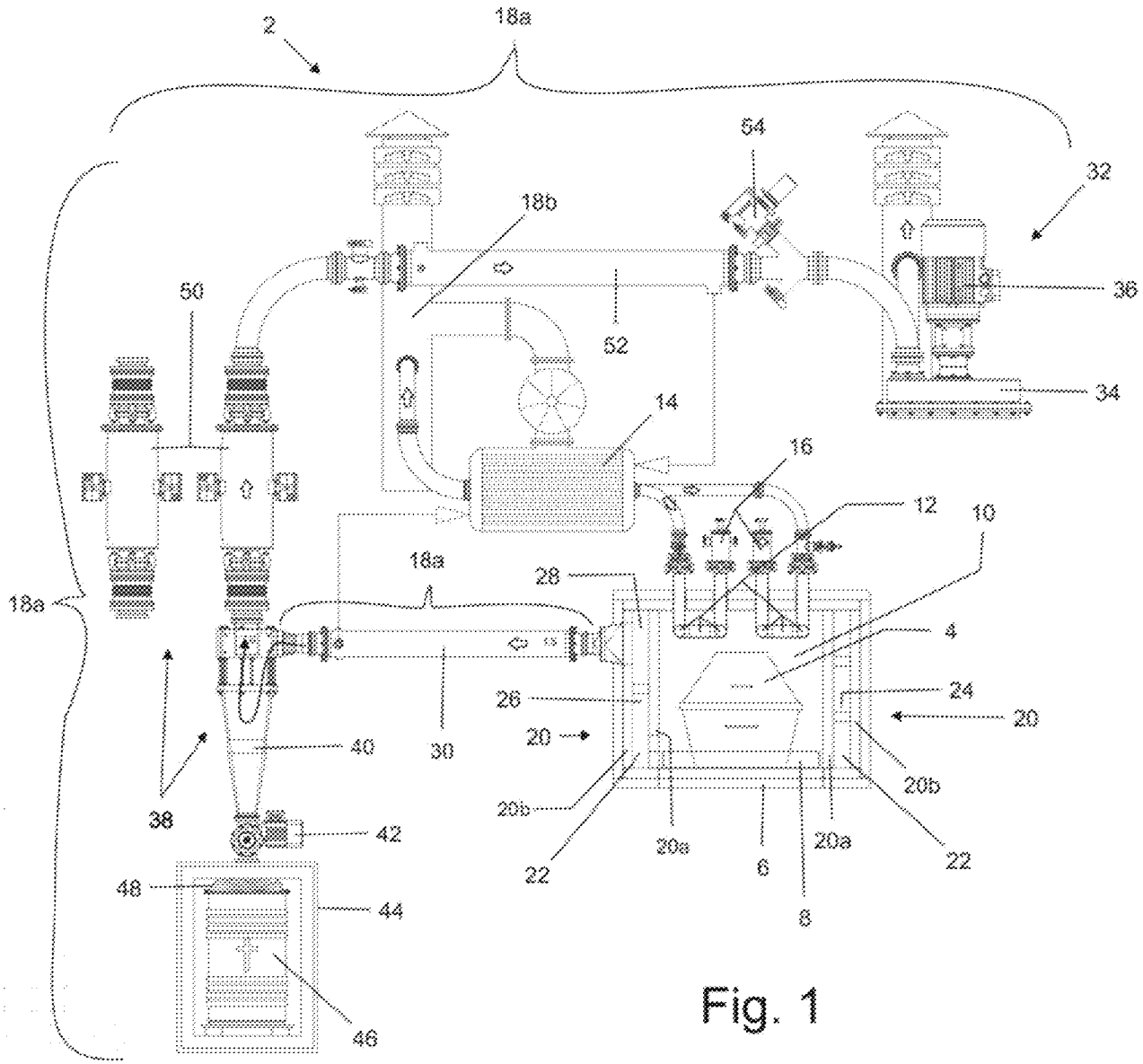
FIG. 1: a schematic illustration of the components of the thermal processing apparatus.

FIG. 1 shows a schematic illustration of the components of the thermal processing apparatus 2. A corpse to be cremated, which may be placed in a casket, which may also be designed as an interchangeable casket, or lies on the bottom segment 6 or an interchangeable vessel 8 placed thereon, is cremated in the cremation chamber 10. The cremation chamber 10 is heated by at least one radiant tube 12. In the embodiment, in the interior of the cremation chamber 10 two manifolds of radiant tubes 12 are provided which are arranged in a loop in the interior of the cremation chamber 10 and are installed such that they cover the ceiling area of the cremation chamber 10 well. The radiant tubes 12 are heated by the heating device 14 that heats a heating medium which, heated by the heating device 14, passes into the radiant tubes 12. In the embodiment, the heating device 14 burns a fuel gas. The heating device 14 is arranged outside of the cremation chamber 10. The heating medium can be in particular the gas of the fuel gas flame of the heating device 14. The exhaust gas of the combustion of a fuel, after it has been heated by the heating device 14, passes into the radiant tubes 12, freely installed in the cremation chamber 10, and exits therefrom again through a connecting line 16 which extends into the exhaust gas manifold 18*b* of the heating device 12. When a circulating heating medium is used, the connecting line 16 can return the heating medium again into the heating device 14 where it is then again heated by the heating device 14. The exhaust gas manifold 18*b* bypasses the cremation chamber 10 and is separated therefrom. Since the radiant tubes 12 are embodied to be gas-tight, the heating medium contained in the radiant tubes cannot pass into the cremation chamber 10. The material of the radiant tubes 12 is designed for an operating temperature above 900° C., and the radiant tubes 12 are manufactured of a high temperature-resistant steel and/or a ceramic material.

The lateral walls 20*a* of the cremation chamber 10 are designed as a double wall 20 in which the intermediate space 12 between the first wall 20*a* which is facing the cremation chamber 10 and the second wall 20*b* which is facing away from the cremation chamber 10 is designed as an air guiding channel 24 for supply of supply air into the cremation chamber 10 or as an air guiding channel 26 for discharging exhaust air from the cremation chamber 10. The double walls 20 comprise for this purpose corresponding openings in the wall surfaces. The air guiding channel 26 for discharge of exhaust air forms in the embodiment at the same time the post-combustion chamber 28.

The exhaust gas manifold 18*a* for discharging the exhaust gases from the cremation chamber 10 is connected to the post-combustion chamber 28. A first component of the exhaust gas manifold 18*a*, viewed in flow direction of the exhaust gas through the exhaust gas manifold 18*a*, is a heat exchanger 30 that is connected to the post-combustion chamber 28. In the heat exchanger 30, heat from the exhaust air flow or exhaust gas from the cremation chamber 10 is transferred to a heat medium. Via the heat medium, the energy absorbed by the heat medium in the heat exchanger 30 can be returned again into the combustion process, which is schematically illustrated simplified by the arrow from the heat exchanger 30 to the heating device 14. Actually, the heat medium circulates between the heat exchanger 30 and an energy recovery device 32 in the form of a steam turbine 34 to which an electric current generator 36 as an electric generator is connected. The heat medium is returned again from the steam turbine 34 in a loop, not illustrated in detail, to the heat exchanger 30.

In the heat exchanger 30, the exhaust gas cools down so that downstream of the exhaust gas manifold 18*a* it can be further processed in an exhaust air processing device 38. In the embodiment, the exhaust air processing device 38 comprises a plurality of components following each other in flow direction of the exhaust gas in the exhaust gas manifold 18*a*.

A first component for processing the exhaust gas is a separator 40 for separation of solids from the exhaust gas which is connected downstream of the post-combustion chamber 28 and the heat exchanger 30 to the exhaust gas manifold 18*a*. In the embodiment, the separator 40 is configured as a cyclone. At the lower outlet of the separator 40, a cycle lock 42 with a rotary valve is arranged with which the solids, which have been separated in the separator 40 during the cremation of a corpse, are metered and discharged into the collection container 44 separate from the solids of the cremation of other corpses. The collection container can be an urn 46, or an urn 46 is positioned in the collection container 44. In order to avoid dust losses upon transfer of solids into the urn 46, a filter cloth adapter 48 can be provided with which the urn 46 is connected to the separator 40 in a dust-tight manner.

A second component for processing the exhaust gases is a dust gas filter 50 which is connected to the separator 40, downstream of the separator 40, for filtration of the exhaust gas. In the exhaust gas filter 50, suspended particles can be filtered out of the exhaust gas. In the embodiment, two dust gas filters 50 connected in parallel and operable alternately are arranged downstream of the separator 40 for filtering the exhaust gas. The dust gas filter which is inactive respectively can be operated in a cleaning mode while the active dust gas filter 50 is loaded with new suspended particles in a cremation process.

The absorption device for further filtration of the exhaust gas, which is connected to the separator 40 or to the dust gas filter 50 downstream of the separator 40, is installed in the embodiment in the filter cartridge of the dust gas filter. Not illustrated in detail in the drawing, there is a lime water cleaning stage which the thermal processing apparatus 2 may comprise and which can also form a component of the exhaust gas manifold 18*a*. The exhaust gas of the cremation chamber 10 can be passed through the lime water cleaning stage with a supply line and a discharge line prior to the exhaust gas being released into the environment. Illustrated in FIG. 1, there is however a heat exchanger 52 which is arranged downstream of the separator 40, the dust gas filter 50 and/or an absorption device in which the exhaust gas from the cremation chamber 10 is further cooled.

The energy removed in the heat exchanger 52 from the exhaust gas is also returned into the combustion process, which is indicated by the corresponding symbol arrow to the heating device 14. Here also a heat medium can be loaded in the heat exchanger with heat which is conveyed to the steam turbine 34 in order to produce electric energy.

Finally, the thermal processing apparatus 2 comprises an interface 54 for measuring pollutants in the exhaust gas manifold 18*a* between the separator 40 and the blow-out end of the exhaust gas manifold 18*a*.

Figure 2:
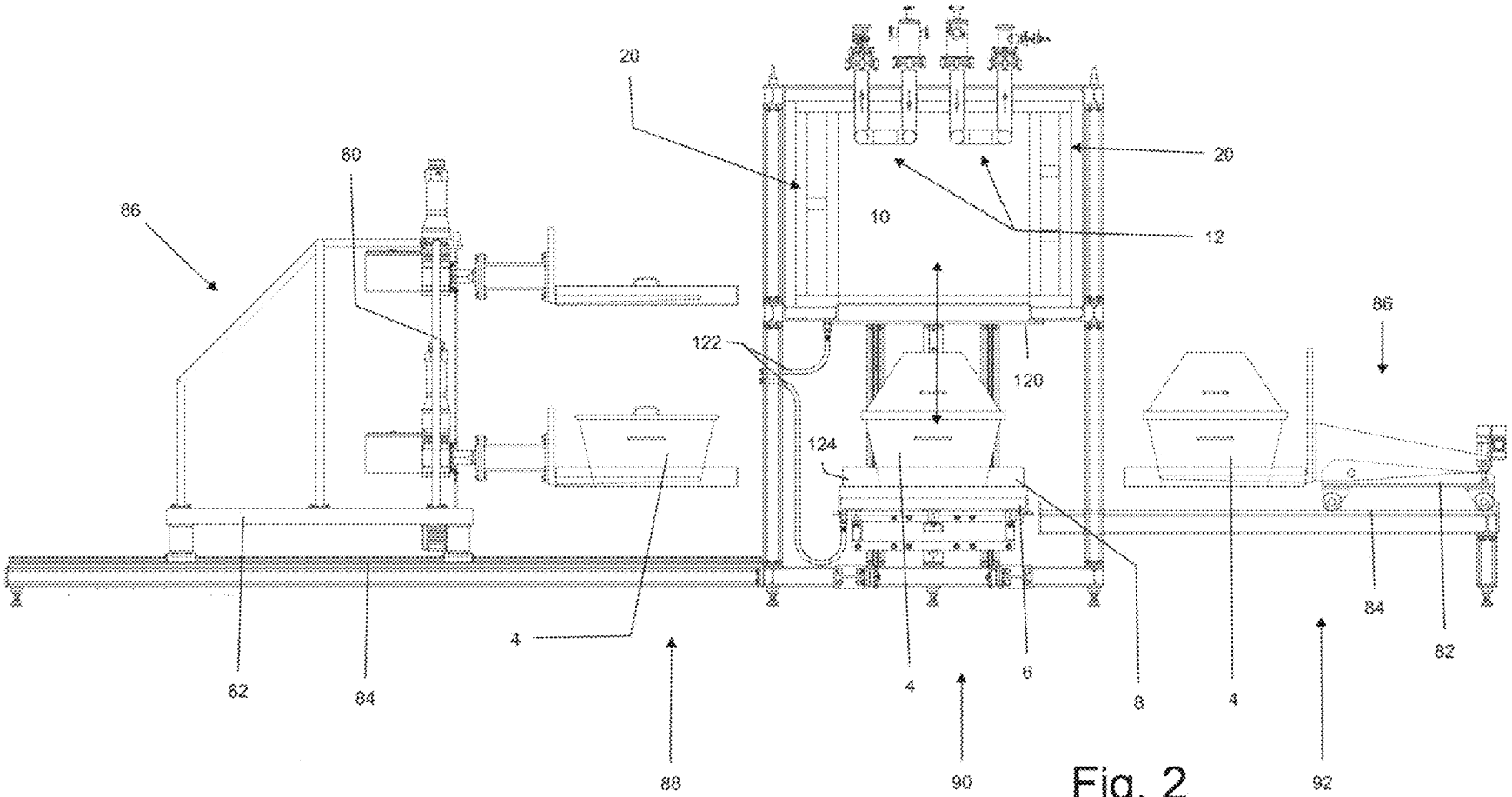
FIG. 2: a schematic illustration of the lifting device for loading and later removal of a corpse from the cremation chamber.

FIG. 2 shows a schematic illustration of the lifting device 80 for loading and later removal of a corpse from the cremation chamber 10. While in FIG. 1 the bottom segment 6 with an interchangeable casket 4 placed thereon is in the closed position that closes the cremation chamber 10 in downward direction, the bottom segment 6 in FIG. 2 is illustrated in the open position lowered downwardly. In the open position of the bottom segment 6, the cremation chamber 10 is open in downward direction.

The bottom segment 6 can comprise thermal insulations, not illustrated in detail, at its circumferential rims and/or at its bottom side and/or at an interface to the lifting device 80. The bottom segment 6 at its circumferential rims and/or at its bottom side and/or at an interface to the lifting device 80 and/or adjoining components of the thermal processing apparatus 2 can comprise water cooling 120. The water cooling 120 is realized in the embodiment by pipes which are positioned around the bottom opening in the cremation chamber 10 and around the bottom segment 6. The cooling hoses 122 of the water cooling 120 connecting the water cooling 120 to a cooler, not illustrated in detail, are also illustrated. The interchangeable vessel 8 can be manufactured of a high temperature-resistant steel and/or a ceramic material in order to be able to withstand the high thermal loads in the cremation chamber 10 during a cremation process. Carrying elements 124 can be formed at the interchangeable vessel 8 by means of which the interchangeable vessel 8 is moveable.

The lifting device 80 is provided in order to be able to move an interchangeable vessel 8 back and forth and up and down, depending on the configuration however also move the bottom segment 6 up and down. The lifting device 80 is arranged on a carriage 82 that is movable back and forth on a track 84, for example, a rail device. The carriage 82 and the track 84 form a conveying device 86. In the left position in FIG. 2, the carriage 82 is still in the loading station 88. In the loading station 88, a casket or an interchangeable casket 4 can be placed onto the interchangeable vessels 8 which are held by the lifting device 80. The lifting device 80 lifts or lowers the interchangeable vessel 8 to a level in which it can be put down on the bottom segment 6.

For this purpose, the carriage 82 moves on the track 84 from the loading station 88 to the interchange station 90 which in the illustration of FIG. 2 is shown in the central region below the cremation chamber 10. In the illustration in FIG. 2, an interchangeable casket 4 with an interchange vessel 8 is already positioned on the bottom segment 6 in the interchange station 90. When the interchangeable vessel 6 is empty and the bottom segment 6 is in the open position, an interchangeable vessel 8 prepared for a new cremation process can be put down the bottom segment 6. The bottom segment 6 is located in this context always in the interchange station 90, it is preferably movable in vertical direction between the open and closed position, as indicated by the double arrow in FIG. 2. After the interchangeable vessel 8 has been put down on the bottom segment 6, the bottom segment 6 can be moved into the closed position with the lifting device 80 or a lifting drive separate therefrom. For starting a new cremation process, the bottom segment 6 is moved out of the open position into the closed position so that the interchangeable vessel 8 with the casket positioned thereon is in the cremation chamber 10 in the closed position of the bottom segment 6. When the cremation process is completed, the bottom segment is moved again from the closed position into the open position so that the interchangeable vessel 8 with the cremated remains, which are lying in the interchangeable vessel 8 or the interchangeable casket 4, can be removed from the bottom segment 6. When the cremation chamber 10 has been supplied with a wooden casket, it is combusted in the cremation process completely with exception of possible minimal ash residues.

The right part of the illustration in FIG. 2 shows the discharge station 92. In the discharge station 92, the interchangeable vessel 8 and the interchangeable casket 4 can be emptied. The interchangeable vessel 8 illustrated here with an interchangeable casket 4 positioned thereon has been beforehand lifted off the bottom segment 6 and has been laterally moved there. The interchangeable vessel 8 located in the discharge station 92 can have been moved there by the conveying device 86, wherein for this purpose however a second conveying device 86 with a second carriage 82 and a track 84 is illustrated in the illustrated embodiment. The embodiment does not show a conveying device 86 which is designed as a conveying carriage with at least two placement positions for interchangeable vessels 8.

Figure 3A:
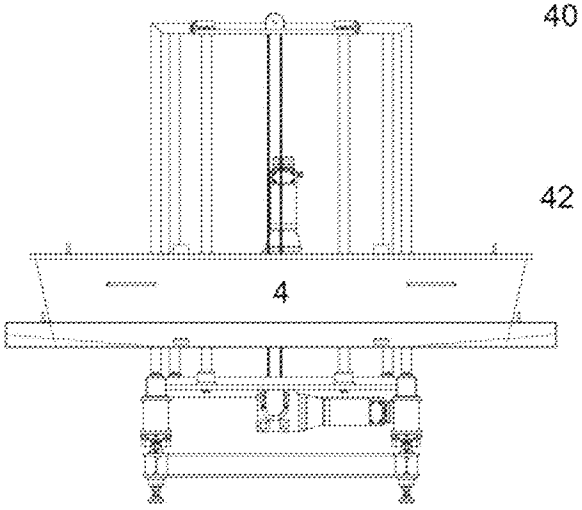
FIGS. 3*a*/3*b*: an interchangeable vessel with an interchangeable casket positioned thereon in a tilting device.
Figure 3B:
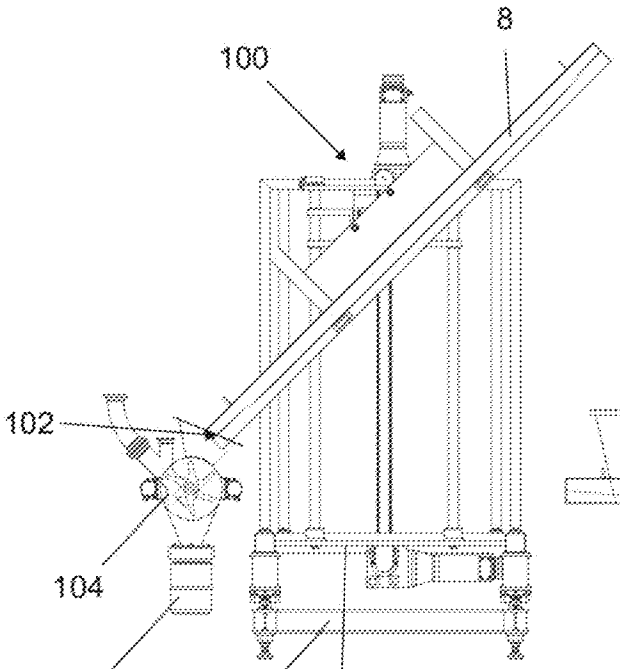

A tilting device 100 for tilting an interchangeable vessel 8 can be embodied at the conveying device 86 or at a different location of the thermal processing apparatus 2. The tilting device 100 can tilt the interchangeable vessel 8 about a horizontal axis, as illustrated in FIG. 3*a* and FIG. 3*b*. In FIG. 3*a*, the interchangeable vessel 8 is still in a horizontal position while in FIG. 3*b* it is illustrated in a tilted position. In the tilted position, the bottom of the interchangeable vessel 8 and/or of the interchangeable casket 4 is in a slanted position. The remains pieces as well as ash from the cremation process which are still located in the interchangeable casket 4 and/or in the interchangeable vessel 8 can be discharged via a solids discharge opening 102, which is located in the interchangeable vessel 8, in the interchangeable casket 4 and/or in a cover, without losses into a grinding processor 104. The ground material and the ash can fall from the grinding processor 104 into an urn 46 arranged below.

Figure 4:
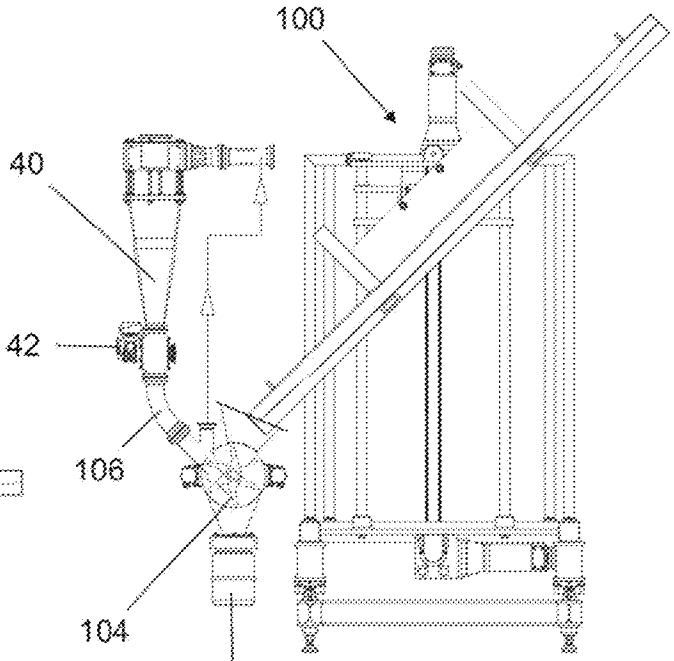
FIG. 4: a tilting device with a grinding processor connected thereto.

In FIG. 4, a tilting device 100 is illustrated in which by a supply means 106 solids which have been separated in the separator 40 can be supplied to the grinding processor 104. The supply means can be a pipe which connects the cycle lock 42 to the grinding processor 104. The solids which are discharged from the cycle lock 42 can however also be directly discharged into the urn 46 which is later on supplied by the grinding processor 104 with the remains of a cremated corpse from the interchangeable casket 4 and/or the interchangeable vessel 8. For this purpose, the urn 46 would have to be repositioned however.

Figure 5:
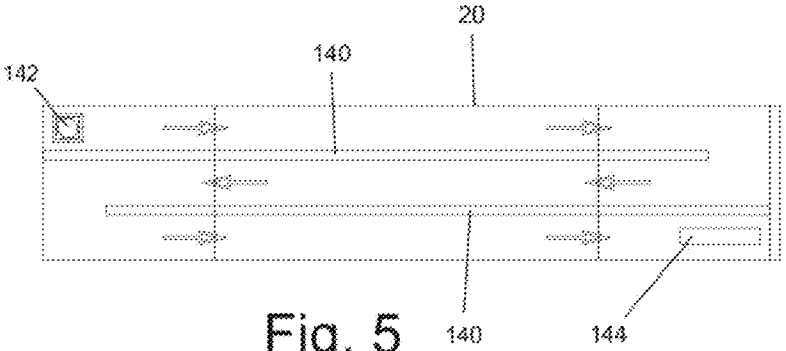
FIG. 5: the developed view of a double wall as an example of an air guiding channel for supply of supply air.

In FIG. 5, the developed view of a sectioned double wall 20 as an example of an air supply channel 24 for supply of supply air into the cremation chamber 10 is illustrated in which the distance traveled by the supply air in the double wall 20 is extended by a plurality of deflections of the flow through one or a plurality of deflection elements 140 arranged in the double wall 20. The supply air passes via the opening 142 into the intermediate space 22 in the intermediate wall 20, flows along the arrows through the labyrinth that is predefined by the deflection elements 140, and exits the intermediate space 22 through the outflow opening 144 that opens into the cremation chamber 10. While the supply air flows through the air guiding channel 24, it is heated by the heated first wall 20*a*.

Figure 6B:
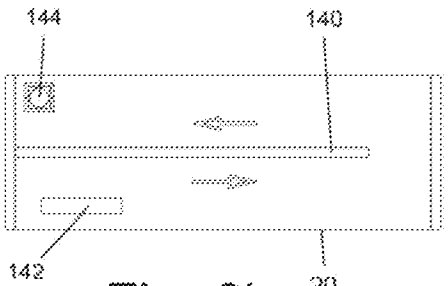
FIGS. 6*a*/6*b*: the developed view of a double wall as an example of an air guiding channel for discharge of exhaust air.
Figure 6A:
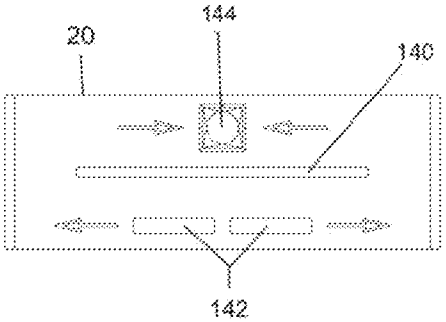

FIG. 6*a* shows a developed view of a sectioned double wall 20 as an example of an air guiding channel 26 for discharge of exhaust air from the cremation chamber 10. With a correspondingly designed and positioned deflection element 140 a long flow path for the hot exhaust gas through the post-combustion chamber 28 results which provides for a good post combustion effect but carries a certain risk of deposition of solids. In this respect, the configuration of the deflection element 140 illustrated in the embodiment of FIG. 6*b* is better in which shorter flow paths but also a shorter residence time of the exhaust gas in the post-combustion chamber 28 result.

Figure 7:
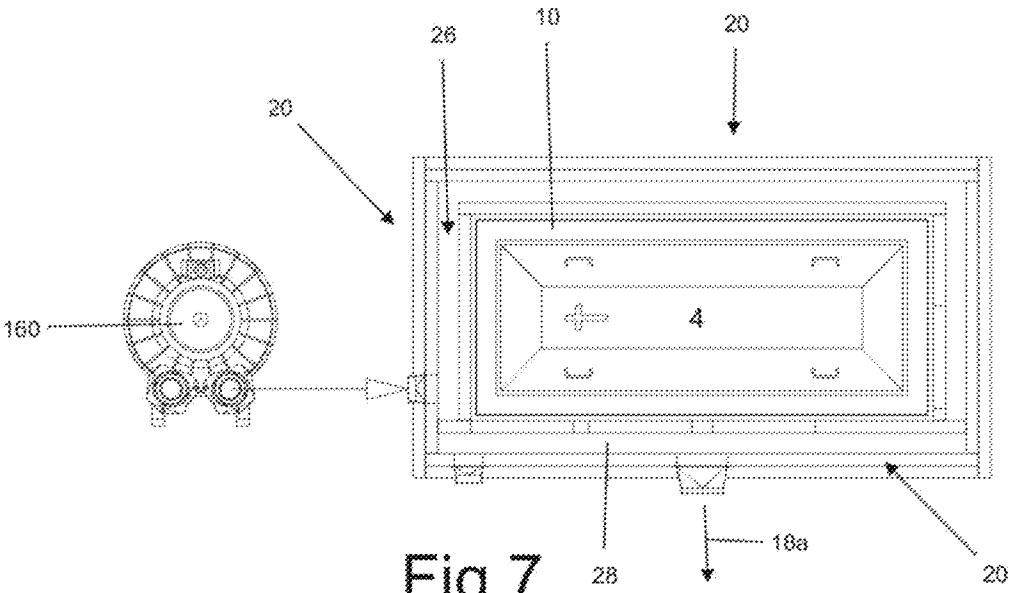
FIG. 7: a cremation chamber with double walls in a view from above with supply air blower.

In FIG. 7, a cremation chamber 10 with double walls 20 is illustrated in a plan view from above with a supply air blower 160. The supply air blower 160 is designed as a side channel blower that forces the supply air into the cremation chamber 10 and, due to the thus created excess pressure, the exhaust gases from the cremation chamber 10 into the post-combustion chamber 28 and into the exhaust gas manifold 18*a*. In order to enable this, the cremation chamber 10 is designed to be gas-tight with the exception of the exhaust air opening into the post-combustion chamber 28.

The invention is not limited to the afore described embodiment. A person of skill in the art will have no difficulties in modifying the embodiment in a manner appearing suitable to him in order to adapt it to a concrete application situation.

The entire disclosure of German priority application DE 10 2022 122 863.0 whose priority date is claimed in the present application is incorporated herein by reference.

LIST OF REFERENCE CHARACTERS

2 thermal processing apparatus
4 interchangeable casket
6 bottom segment
8 interchangeable vessel
10 cremation chamber
12 radiant tube
14 heating device
16 connection line
18 exhaust gas manifold
20 double wall
22 intermediate space
24 air guiding channel for supply of supply air
26 air guiding channel for discharging exhaust air supply of supply air
28 post-combustion chamber
30 heat exchanger
32 energy recovery device
34 steam turbine
36 current generator
38 exhaust air processing device
40 separator
42 cycle lock
44 collection container
46 urn
48 filter cloth adapter
50 dust gas filter
52 heat exchanger
54 interface
80 lifting device
82 carriage
84 track

86 conveying device
88 loading station
90 interchange station
92 discharge station
100 tilting device
102 solids discharge opening
104 grinding processor
106 supply means
120 water cooling
122 cooling hose
124 carrying element
140 deflection element
142 opening
144 outflow opening
160 supply air blower

What is claimed is:

1. A thermal processing apparatus comprising:

a cremation chamber;

a heating device configured to heat the cremation chamber;

an air supply device configured to feed supply air to the cremation chamber;

a first exhaust gas manifold configured to discharge an exhaust air from the cremation chamber, the first exhaust gas manifold comprising an exhaust air processing device;

a post-combustion chamber arranged downstream of the cremation chamber;

wherein the heating device is configured to burn hydrogen;

wherein the heating device comprises burner nozzles and burner sleeves, wherein the burner nozzles and the burner sleeves are comprised of a material selected from the group consisting of a high temperature-resistant steel, a ceramic material, and a composite material, and combinations thereof.

2. The thermal processing apparatus according to claim 1, wherein the heating device is operatively connected to a gas-tight radiant tube, wherein the gas-tight radiant tube is arranged in an interior of the cremation chamber and wherein the heating device heats the gas-tight radiant tube.

3. The thermal processing apparatus according to claim 1, wherein the heating device is arranged outside of the cremation chamber.

4. The thermal processing apparatus according to claim 1, wherein a second exhaust gas manifold is connected to the heating device and is configured to discharge an exhaust gas produced by combusting the hydrogen into an environment by bypassing the cremation chamber.

5. The thermal processing apparatus according to claim 1, wherein the cremation chamber comprises walls, wherein at least one of the walls of the cremation chamber is configured as a double wall comprising a first wall and a second wall and an intermediate space between the first wall and the second wall, wherein the first wall is facing the cremation chamber and the second wall is facing away from the cremation chamber, wherein the intermediate space is an air guiding channel for supply of the supply air into the cremation chamber or for discharge of the exhaust air from the cremation chamber.

6. The thermal processing apparatus according to claim 5, wherein a plurality of deflection elements are arranged in the intermediate space of the double wall so that a flow of the supply air or of the exhaust air in the double wall is deflected by the plurality of deflection elements and a distance to be traveled by the flow of the supply air or of the exhaust is extended.

7. The thermal processing apparatus according to claim 5, wherein the intermediate space is utilized for heating the supply air or the intermediate space provides the post-combustion chamber for the exhaust air, wherein a first double wall volume of the intermediate space for heating the supply air is larger than a second double wall volume of the intermediate space utilized as the post-combustion chamber.

8. The thermal processing apparatus according to claim 1, further comprising a lifting device, wherein the cremation chamber comprises a bottom segment, wherein the lifting device is connected to the bottom segment and configured to move back and forth the bottom segment in a vertical direction between a closed position closing the cremation chamber in a downward direction and an open position arranged below the closed position, wherein the cremation chamber is opened in the downward direction in the open position.

9. The thermal processing apparatus according to claim 8, wherein the bottom segment comprises thermal insulation at circumferential rims thereof and/or at a bottom side thereof and/or at an interface thereof to the lifting device.

10. The thermal processing apparatus according to claim 8, further comprising water cooling arranged at the bottom segment at circumferential rims thereof and/or at a bottom side thereof and/or at an interface thereof to the lifting device and/or arranged at components of the thermal processing apparatus adjoining the bottom segment.

11. The thermal processing apparatus according to claim 8, wherein the bottom segment is connected to an interrupter switch configured to shut off or regulate down the heating device, a supply air blower of the air supply device and/or an exhaust air blower when the bottom segment is not in the closed position.

12. The thermal processing apparatus according to claim 8, further comprising an interchangeable vessel configured to be placed onto the bottom segment, wherein the interchangeable vessel comprises carrying elements, wherein the interchangeable vessel is moveable by the carrying elements.

13. The thermal processing apparatus according to claim 12, wherein the interchangeable vessel is comprised of a material selected from the group consisting of a high temperature-resistant steel, a ceramic material, and a composite material, and combinations thereof.

14. The thermal processing apparatus according to claim 12, further comprising a conveying device arranged below the cremation chamber, wherein the conveying device comprises a loading station, an interchange station, and a discharge station, wherein the conveying device is configured to supply the interchangeable vessel to the bottom segment and/or to remove the interchangeable vessel from the bottom segment.

15. The thermal processing apparatus according to claim 14, wherein the conveying device further comprises a conveying carriage with at least two placement positions for the interchangeable vessel.

16. The thermal processing apparatus according to claim 14, wherein a solids discharge opening is provided at the interchangeable vessel and/or at an interchangeable casket.

17. The thermal processing apparatus according to claim 12, further comprising a tilting device for tilting the interchangeable vessel and/or an interchangeable casket, wherein the tilting device optionally comprises a cover with a solids discharge opening.

18. The thermal processing apparatus according to claim 17, further comprising an inspection station arranged upstream or downstream of the tilting device and arranged upstream of a grinding processor for inspecting cremated remains of a corpse, wherein the inspection station comprises a metal separator.

19. The thermal processing apparatus according to claim 1, further comprising an electronic control and regulation device for process control of a cremation process in the thermal processing apparatus, wherein the air supply device comprises a supply air blower connected to cremation chamber and/or an exhaust air blower is connected to the first exhaust gas manifold, wherein the supply air blower and/or the exhaust air blower are connected to the electronic control and regulation device, wherein the control and regulation device comprises a software program configured to regulate conveying outputs of the supply air blower and/or of the exhaust air blower.

20. The thermal processing apparatus according to claim 19, wherein the supply air blower and/or the exhaust air blower can be regulated by the software program to output values adjusting an atmospheric pressure or an excess pressure in the cremation chamber.

21. The thermal processing apparatus according to claim 1, wherein the air supply device comprises a supply air blower connected to the cremation chamber, wherein the thermal processing apparatus has no exhaust air blower, wherein the supply air blower forces the exhaust air from the cremation chamber into the post-combustion chamber and into the first exhaust gas manifold, and wherein the cremation chamber is gas-tight with the exception of an exhaust air opening to the post-combustion chamber.

22. The thermal processing apparatus according to claim 1, further comprising a heat exchanger connected to the post-combustion chamber and further comprising an energy recovery device, wherein heat from an exhaust air flow is transferred to a heat medium circulating between the heat exchanger and the energy recovery device in a loop.

23. The thermal processing apparatus according to claim 22, wherein the heat medium is a phase-changing liquid and the energy recovery device is a steam turbine driven by the phase-changing liquid, wherein the steam turbine has arranged downstream thereof a current generator driven by the steam turbine, and wherein the current generator converts a rotation energy of the steam turbine into electric current.

24. The thermal processing apparatus according to claim 1, wherein the exhaust air processing device comprises a separator for separation of solids from the exhaust air, wherein the separator is connected downstream of the post-combustion chamber.

25. The thermal processing apparatus according to claim 24, further comprising a collection container connected to the separator and further comprising a cycle lock arranged between the collection container and the separator.

26. The thermal processing apparatus according to claim 24, wherein the exhaust air processing device further comprises a dust gas filter connected to the separator downstream of the separator in a flow direction of the exhaust air and configured to filter the exhaust air.

27. The thermal processing apparatus according to claim 26, wherein the exhaust air processing device further comprises an absorption device connected to the separator or connected to the dust gas filter and configured to filter the exhaust air.

28. The thermal processing apparatus according to claim 27, further comprising a heat exchanger arranged between the separator, the dust gas filter and/or the absorption device.

29. The thermal processing apparatus according to claim 24, wherein the exhaust air processing device further comprises at least two dust gas filters for filtering the exhaust gas, connected in parallel and alternately operable, arranged downstream of the separator in a flow direction of the exhaust air, wherein a respective inactive dust gas filter of the at least two dust gas filters is operable in a cleaning mode.

30. The thermal processing apparatus according to claim 24, further comprising an interface for pollutant measurement arranged at the first exhaust gas manifold at a location between the separator and a blow-out end of the first exhaust gas manifold.

31. The thermal processing apparatus according to claim 1, wherein the exhaust air processing device further comprises a lime water cleaning stage, wherein the exhaust gas is passed via a supply line and a discharge line through the lime water cleaning stage prior to being released into the environment.

32. The thermal processing apparatus according to claim 1, wherein the first exhaust gas manifold comprises a branch, wherein a line connected to the cremation chamber is connected to the branch for return of at least a portion of the exhaust gas into the cremation chamber.

33. A method for cremating a corpse in a thermal processing apparatus according to claim 1, the method comprising heating the cremation chamber with the heating device configured to burn hydrogen.

34. A thermal processing apparatus comprising:

a cremation chamber;

a heating device configured to heat the cremation chamber;

an air supply device configured to feed supply air to the cremation chamber;

a first exhaust gas manifold configured to discharge an exhaust air from the cremation chamber, the first exhaust gas manifold comprising an exhaust air processing device;

a post-combustion chamber arranged downstream of the cremation chamber;

wherein the heating device is configured to burn hydrogen;

wherein the heating device is operatively connected to a gas-tight radiant tube, wherein the gas-tight radiant tube is arranged in an interior of the cremation chamber and wherein the heating device heats the gas-tight radiant tube;

wherein the gas-tight radiant tube is designed for an operating temperature above 900° C. and is comprised of a material selected from the group consisting of a high temperature-resistant steel, a ceramic material, and a composite material, and combinations thereof.

* * * * *